US005370203A

United States Patent [19]

Kiska

[11] Patent Number: 5,370,203

[45] Date of Patent: Dec. 6, 1994

[54] LADDER SHOE SPUR PLATE

[75] Inventor: Stanley A. Kiska, Greenville, Pa.

[73] Assignee: Werner Co., Greenville, Pa.

[21] Appl. No.: 10,271

[22] Filed: Jan. 28, 1993

[51] Int. Cl.[5] ..... E06C 7/42

[52] U.S. Cl. ..... 182/111; 182/109

[58] Field of Search ..... 182/108–111, 182/107

[56] References Cited

U.S. PATENT DOCUMENTS

| | | | |
|---|---|---|---|
| 412,199 | 10/1889 | McIlhenny | 182/109 |
| 1,973,226 | 9/1934 | Rose et al. . | |
| 2,309,484 | 1/1943 | Van Meter . | |
| 2,691,479 | 10/1954 | Sharp . | |
| 2,767,898 | 10/1956 | Cramer . | |
| 4,415,062 | 11/1983 | Shaw . | |
| 4,694,932 | 9/1987 | Schmitt . | |
| 5,154,255 | 10/1992 | Kiska et al. . | |

FOREIGN PATENT DOCUMENTS

| | | |
|---|---|---|
| 110879 | 4/1968 | United Kingdom . |

OTHER PUBLICATIONS

Three (3) photographs.

*Primary Examiner*—Alvin C. Chin-Shue
*Attorney, Agent, or Firm*—Ansel M. Schwartz

[57] ABSTRACT

A ladder shoe that comprises a ladder rail attachment portion which attaches to a ladder rail of a ladder. The ladder shoe is also comprised of a base. The base comprises an elongate portion having a first side and a second side, a first edge and a second edge, a top face and a bottom face. The top face is attached to the ladder rail attachment portion. The base is also preferably comprised of a foot pad. Additionally, the base is comprised of a blade portion extending from the first edge. Moreover, the base is comprised of a first flange portion extending from said bottom face and integrally connected therewith. There is a second flange portion extending from the bottom face and integrally connected thereto. Additionally, the base comprises a third flange portion extending from the bottom face and integrally connected thereto; and a fourth flange portion extending from the bottom face integrally connected thereto. The elongate portion and first and second and third and fourth flange portions are one continuous piece. The first and second and third and fourth flange portions form a pocket in which the footpad is held along the bottom face and sides of the footpad are protected. The hook portion of the first flange portion faces the hook portion of the second flange portion and holds the footpad. The elongate portion, first flange, second flange and blade portion are one continuous piece. The first and second flanges are disposed such that they retain the foot pad along the bottom face. The present invention also pertains to the base itself.

19 Claims, 7 Drawing Sheets

LADDER SHOE SPUR PLATE

FIELD OF THE INVENTION

The present invention pertains to a ladder shoe. More specifically, the present invention pertains to a ladder shoe having a base with an elongate portion and flanges that is one continuous piece.

BACKGROUND OF THE INVENTION

Ladder shoes are used to provide increased stability to a ladder during use. The shoes typically have a flat portion with a foot pad which engages a flat support surface such as a road, driveway, floor, etc. The shoes also have a blade portion which extend in parallel with the flat portion such that when the ladder shoes are in a position where the blade portion aligns with the ladder rail, the blade portion can penetrate a relatively softer support surface, such as dirt or grass to better anchor the ladder. Heretofore, ladders did not have the blade portion part of a one-piece base for the ladder that also had a pocket which held and protected the foot pad.

SUMMARY OF THE INVENTION

The present invention pertains to a ladder shoe. The ladder shoe comprises a ladder rail attachment portion which attaches to a ladder rail of a ladder. The ladder shoe is also comprised of a base. The base comprises an elongate portion having a first side and a second side, a first edge and a second edge, a top face and a bottom face. The top face is attached to the ladder rail attachment portion. The base is also preferably comprised of a foot pad. Additionally, the base is comprised of a blade portion extending from the first edge. Moreover, the base is comprised of a first flange portion extending from said bottom face and integrally connected therewith. There is a second flange portion extending from the bottom face and integrally connected thereto. Additionally, the base comprises a third flange portion extending from the bottom face and integrally connected thereto; and a fourth flange portion extending from the bottom face integrally connected thereto. The elongate portion and first and second and third and fourth flange portions are one continuous piece. The first and second and third and fourth flange portions form a pocket in which the footpad is held along the bottom face and sides of the footpad are protected. The hook portion of the first flange portion faces the hook portion of the second flange portion and holds the footpad. The elongate portion, first flange, second flange and blade portion are one continuous piece. The first and second flanges are disposed such that they retain the foot pad along the bottom face. The present invention also pertains to the base itself.

BRIEF DESCRIPTION OF THE DRAWINGS

In the accompanying drawings, the preferred embodiment of the invention and preferred methods of practicing the invention are illustrated in which.

DESCRIPTION OF THE PREFERRED EMBODIMENT

Figure 1C:
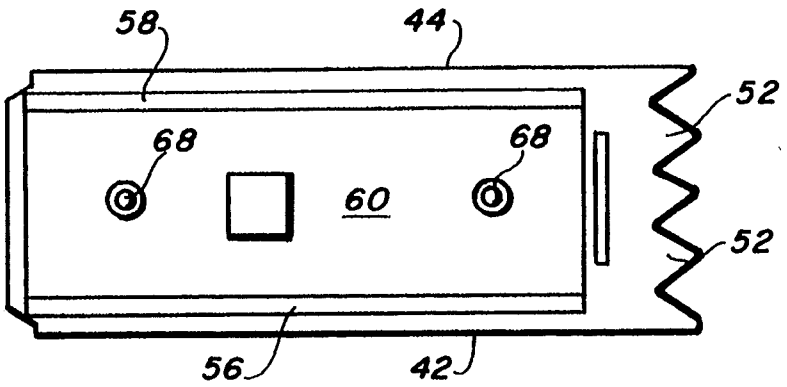
FIG. 1*c* is a top view of the ladder shoe.
Figure 1A:
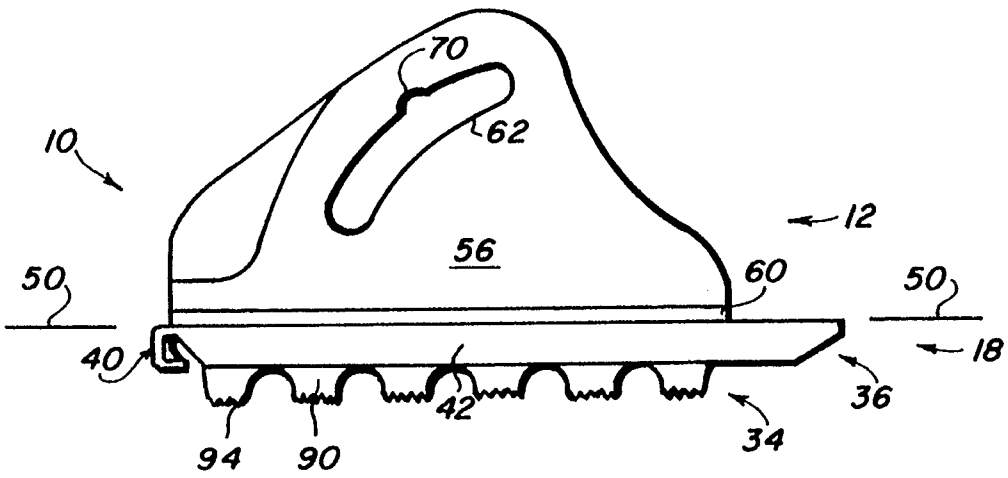
FIG. 1*a* is a side view of a ladder shoe of the present invention.
Figure 1B:
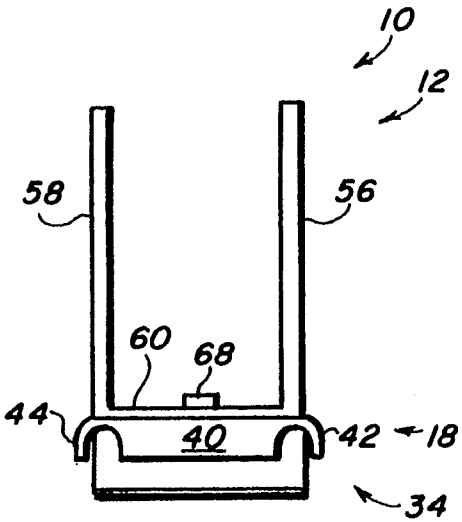
FIG. 1*b* is an end view of the ladder shoe.
Figure 2A:
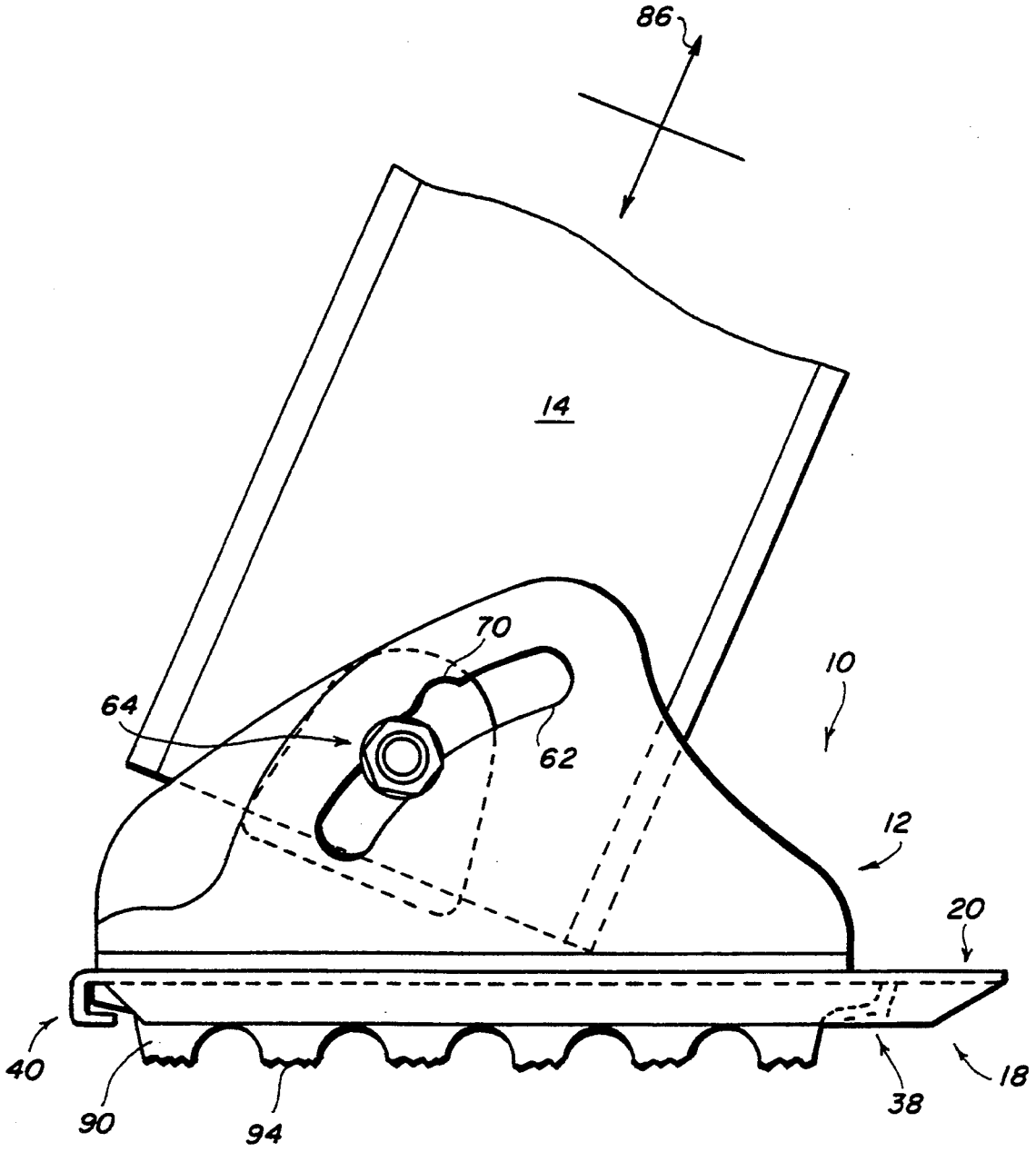
FIG. 2*a* is a side view of a ladder shoe connected to a ladder rail.
Figure 3A:
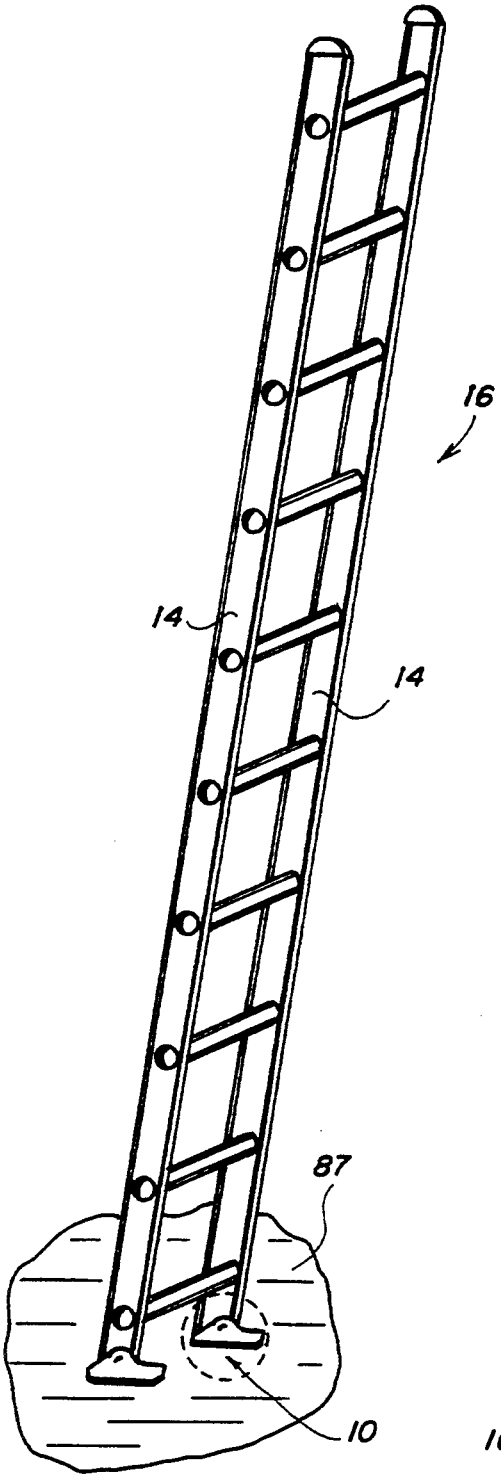
FIG. 3*a* is a perspective view of a ladder having ladder shoes in a first position.
Figure 3B:
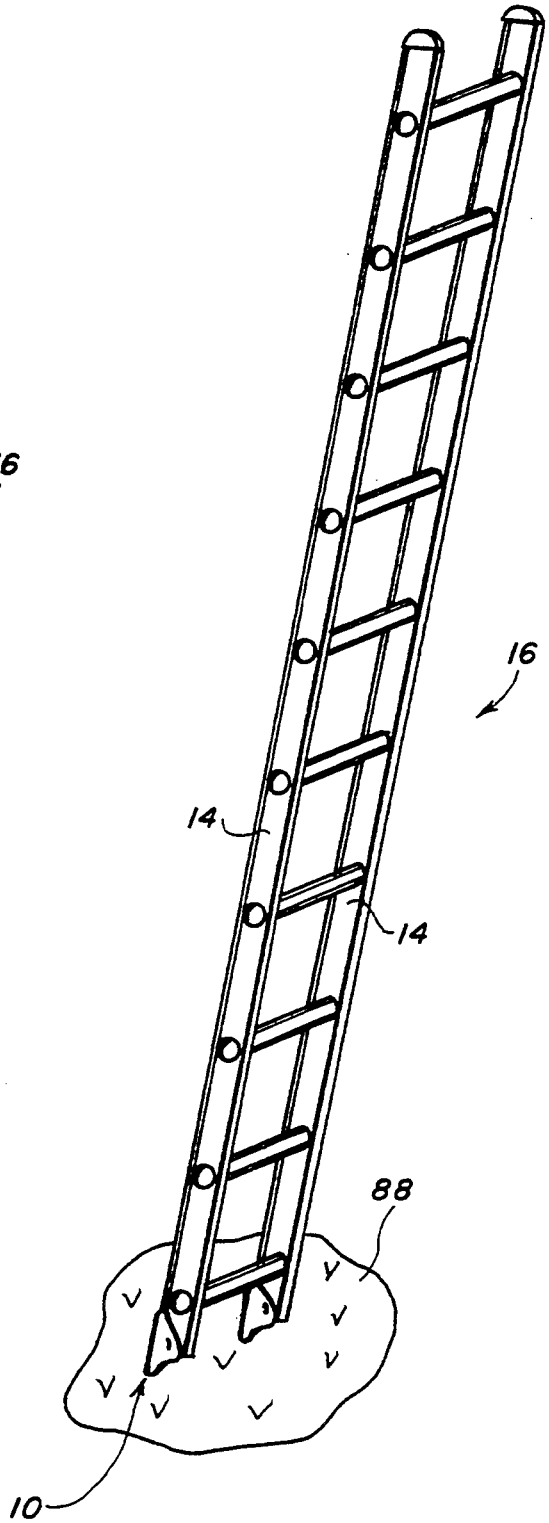
FIG. 3*b* is a perspective view of a ladder having ladder shoes in a second position.
Figure 5:
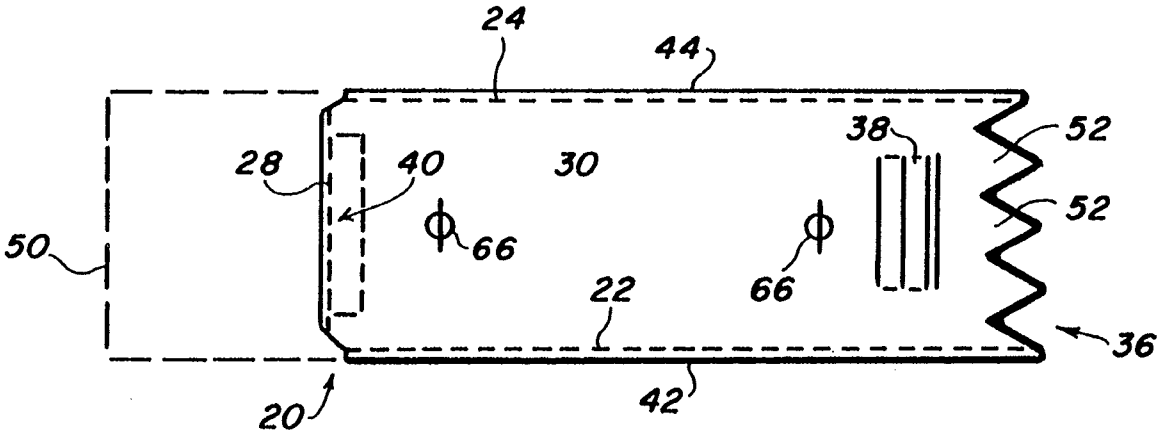
FIG. 5 is a top view of the elongate portion.
Figure 4:
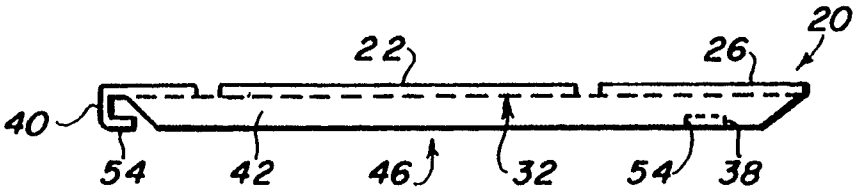
FIG. 4 is a side view of an elongate portion of a base of the ladder shoe.
Figure 6:
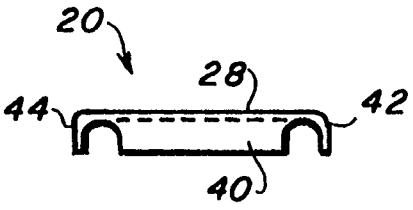
FIG. 6 is an end view of the elongate portion.
Figure 7B:
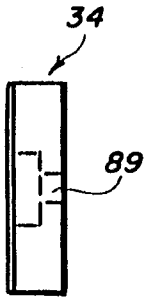
FIG. 7*b* is an end view of the foot pad.
Figure 9:
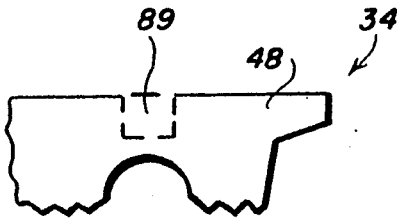
FIG. 9 is an enlarged view of a portion of the foot pad of FIG. 8.
Figure 7A:
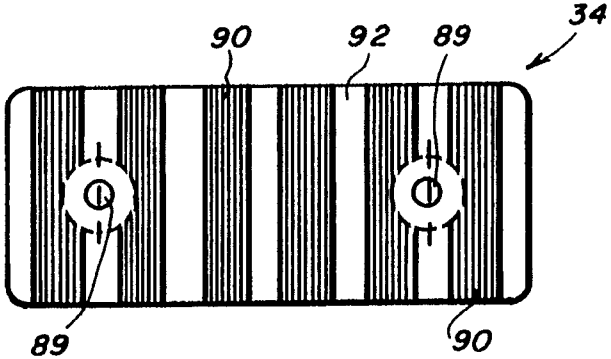
FIG. 7*a* is a bottom view of a foot pad of the ladder shoe.
Figure 8:
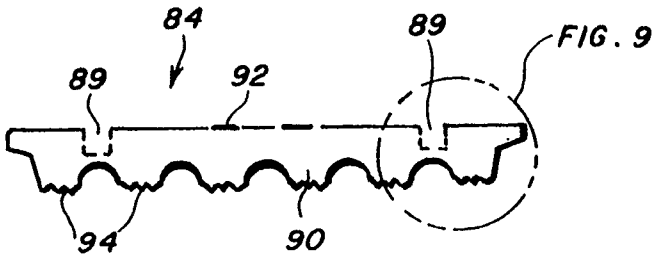
FIG. 8 is a side view of the foot pad.

Referring now to the drawings wherein like reference numerals refer to similar or identical parts throughout the several views, and more specifically to FIGS. 1*a*, 1*b* and 1*c* thereof, there is shown a schematic representation of a side view, rear view and top view, respectively, of a ladder shoe 10. The ladder shoe 10 is comprised of a ladder rail attachment portion 12 which attaches to a ladder rail 14 of a ladder 16, as shown in FIGS. 2*a*, 2*b* and FIGS. 3*a* and 3*b*. The ladder shoe 10 is also comprised of a base 18 as shown in FIGS. 4, 5 and 6. The base 18 is comprised of an elongate portion 20 having a first side 22 and a second side 24, a first edge 26 and a second edge 28, a top face 30 and a bottom face 32. The top face 30 is attached to the ladder rail attachment portion 12. Preferably, the elongate portion 20 is flat and defines a plane 50. The first edge 26 is preferably connected to the first side 22 and the second side 24, and the second edge 28 is connected to the first side 22 and the second side 24. Preferably, the first edge 26 opposes the second edge 28 and the first side 22 opposes the second side 24. The first edge 26, second edge 28, first side 22 and second side 24 preferably form a rectangular shape.

The base 18 is also preferably comprised of a foot pad 34, as shown in FIGS. 7*a*, 7*b*, 8 and 9. Moreover, the base 18 is comprised of a blade portion 36 extending from the first edge 26, as shown in FIG. 5. The blade portion 36 preferably includes a plurality of teeth 52. The blade portion 36 preferably extends from the first edge 26 along the plane 50. There is a first flange portion 38 extending from the bottom face 32 and integrally connected therewith. Additionally, the base 18 is comprised of a second flange portion 40 extending from the bottom face 32 and integrally connected thereto. Preferably, the first flange portion 38 and second flange portion 40 each have a hook portion 54, with hook portion 54 of the first flange portion 38 facing the hook portion 54 of the second flange portion 40, as shown in FIG. 4. The first and second flange portions 38, 40 are disposed such that they retain the foot pad 34 along the bottom face 32, as shown in FIG. 1*a*.

The base 18 preferably includes a third flange 42 extending from the bottom face 32 and integrally connected thereto, as shown in FIGS. 4, 5 and 6. The base 18 preferably also includes a fourth flange portion extending from the bottom face 32 and integrally connected thereto. The elongate portion 20, first flange portion 38, second flange portion 40, blade portion 36 and preferably the third and fourth flange portions 42, 44 are one continuous piece. The various portions are formed in a progressive tool stamping process which punches holes, cuts and bends the piece of material into the elongate portion and the various flange portions. The elongate portion 20, the blade portion 36, and the first, second, third and fourth flange portions 38, 40, 42, 44 are made of metal and preferably 1010 CR carbon steel 14 CA with a plating of zinc having a chromate finish, ASTM B633-85, Class Fe/Zn 12 type III. The zinc plating is preferably 0.0005 inches thick. The first, second, third and fourth flange portions 38, 40, 42, 44 preferably form a pocket 46 in which the foot pad 34 is held along the bottom face 32 and sides 48 of the foot pad 34 are protected. The first flange portion 38 preferably opposes the second flange portion 40 and the third flange portion 42 preferably opposes the fourth flange portion 44.

Preferably, the second flange portion 40 extends from the bottom face 32 along the second edge 28. The third flange portion 42 preferably extends from the bottom face 32 along the first side 22. The fourth flange portion 44 preferably extends from the bottom face 32 along the second side 24. Moreover, the first flange portion 38 preferably extends from the bottom face 32 adjacent to the first edge 26.

Figure 11:
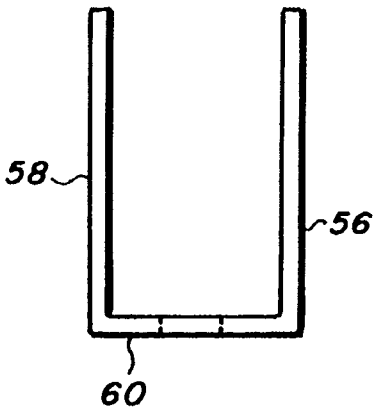
FIG. 11 is an end view of the ladder rail attachment portion.
Figure 10:
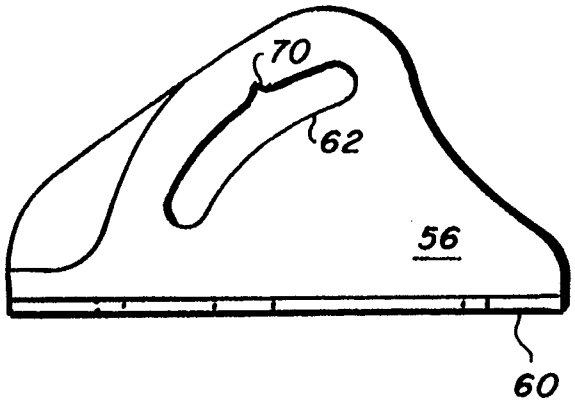
FIG. 10 is a side view of the ladder rail attachment portion of the ladder shoe.
Figure 12:
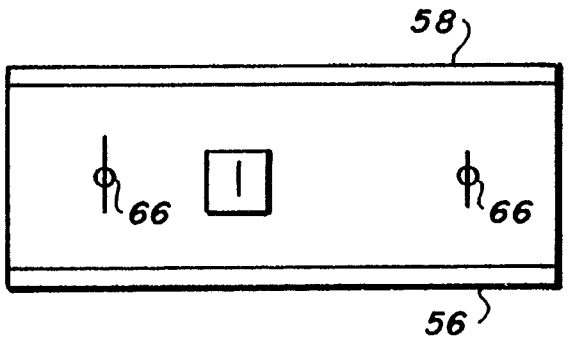
FIG. 12 is a top view of a ladder rail attachment portion.

Preferably, the ladder rail attachment portion 12 includes a first side plate portion 56, a second side plate portion 58 and a bottom plate portion 60, as shown in FIGS. 10, 11 and 12. The first side plate portion 56 is preferably in spaced relationship with the second side plate portion 58 and in parallel with the second side plate portion 58. The first side plate portion 56 and the second side plate portion 58 are integrally connected to the bottom plate portion 60. The first side plate portion 56, the second side plate portion 58 and the bottom plate portion 60 are preferably one continuous piece. The bottom plate portion 60 is attached to the top face 30.

Preferably, the side plate portions 56, 58 have curved slots 62 through which a fastener 64 is disposed, as shown in FIGS. *2a* and *2b*, which movably connects the ladder rail attachment portion 12 so the ladder rail attachment portion 12 can move between a first position where the base 18 is at a first angle with respect to the ladder rail 14, as shown in FIG. *3a*, and a second position where the base 18 is at a second angle with respect to the ladder rail 14, as shown in FIG. *3b*.

In the operation of the preferred embodiment, a ladder shoe 10 is connected with a fastener 64 to the bottom of a ladder rail 14 of a ladder 16 through its ladder rail attachment portion 12. The ladder rail attachment portion 12 has a first side plate portion 56, a second side plate portion 58 and a bottom plate portion 60, as shown in FIG. 11. The bottom plate portion 60 connects the first side plate portion 58 with the second side plate portion 58 and maintains them in spaced relationship. The ladder rail attachment portion 12 is made out of a single continuous piece of aluminum. The bottom plate portion 60 has two holes 66, as shown in FIG. 12, through which rivets 68 are inserted into corresponding holes 66 in the elongate portion 20 to hold the elongate portion 20 to the ladder rail attachment portion 12.

The first side plate portion 56 and the second side plate portion 58 each have a slot 62, as shown in FIG. 10. Each slot 62 has a notch 70. The notch 70 in the slot 62 allows the ladder shoe 10 to be maintained in an intermediate position so that it can readily and easily move into either the first position as shown in FIG. *3a*, or into the second position as shown in FIG. *3b*. A full discussion of the notch 70 and the slot 62 and its operation with respect to a ladder shoe is found in U.S. Pat. No. 5,154,255 to S. A. Kiska and R. P. Sulecki, incorporated by reference.

The foot pad 34, as shown in FIGS. *7a*, *7b*, 8 and 9, is made of PVC material, having a UV and heat stabilizer of either barium or cadmium of no more than 1%, a filler of calcium carbonate of no more than 7% and a plasticizer of the phthalate type. It should have a brittleness temperature (ASTM DS46) of −30° F. or lower, a hardness value (ASTM D2240) of sphere A 75±5, a tensile strength of at least 1300 psi and elongation of at least 300% of the minimum. The foot pad 34 is comprised of a plurality of tread platforms 90, and preferably six tread platforms 90 which extend from a foot pad platform 92. Each of the tread platforms 90 have individual treads 94 to better grip the support surface 87. The plurality of tread platforms 90 allow for further conformance of the overall gripping surface defined by all the treads 94 of the tread platforms 90 with the support surface 87. Rivets 68 extend through pad holes 89 of foot pad 34 into elongate portion 20, to secure the foot pad 36 to the bottom face 32 of the elongate portion 20.

The base 18 of the ladder shoe 10 is comprised of an elongate portion 20, as shown in FIGS. 4, 5 and 6. The elongate portion 20 includes a first side 22, a second side 24, a first edge 26 connected to the first side 22 and second side 24, and a second edge 28 connected to the first side 22 and second side 24. The first side 22 opposes the second side 24 and the first edge 26 opposes the second edge 28 such that the elongate portion essentially is in the shape of a rectangle. The elongate portion 20 has a top face 30 to which the bottom plate portion 60 is in contact. From the first edge 26 extends a blade portion 36 in the plane 50. The blade portion 36 is comprised of teeth 52.

Adjacent to the first edge 26 is a first flange portion 38 which extends from the bottom face 32 of the elongate portion 20. From the bottom face 32 along the second edge 28 extends a second flange portion 40. Along the first side 22 extends the third flange portion 42 and along the second side 24 extends a fourth flange portion 44.

The first flange portion 38 and second flange portion 40 each have a hook portion 54. Each hook portion 54 faces the other. The first, second, third and fourth flange portions together form a pocket 46 in which the foot pad 34 is disposed and the sides of the foot pad 48 are protected. The hook portions 54 of the first flange portion 38 and second flange portion 40 hold the foot pad 34 in place along the bottom face 32. The foot pad 34 is inserted into the pocket 46 by the foot pad 48 being slightly folded so that the length of the foot pad 34 is smaller than the length between the first flange portion 38 and the second flange portion 40. Once the folded foot pad is placed against the bottom face 32, it is allowed to unfold as it is held against the bottom face 32, thus fitting between the hook portion 54 of each of the first flange portion 38 and second flange portion 40, and along the bottom face 32 of the elongate portion 20. The third flange portion 42 and fourth flange portion 44 not only serve to protect the sides 48 of the foot pad 34 but also prevent the foot pad 34 from sliding out from the first flange portion 38 and second flange portion 40.

Figure 2B:
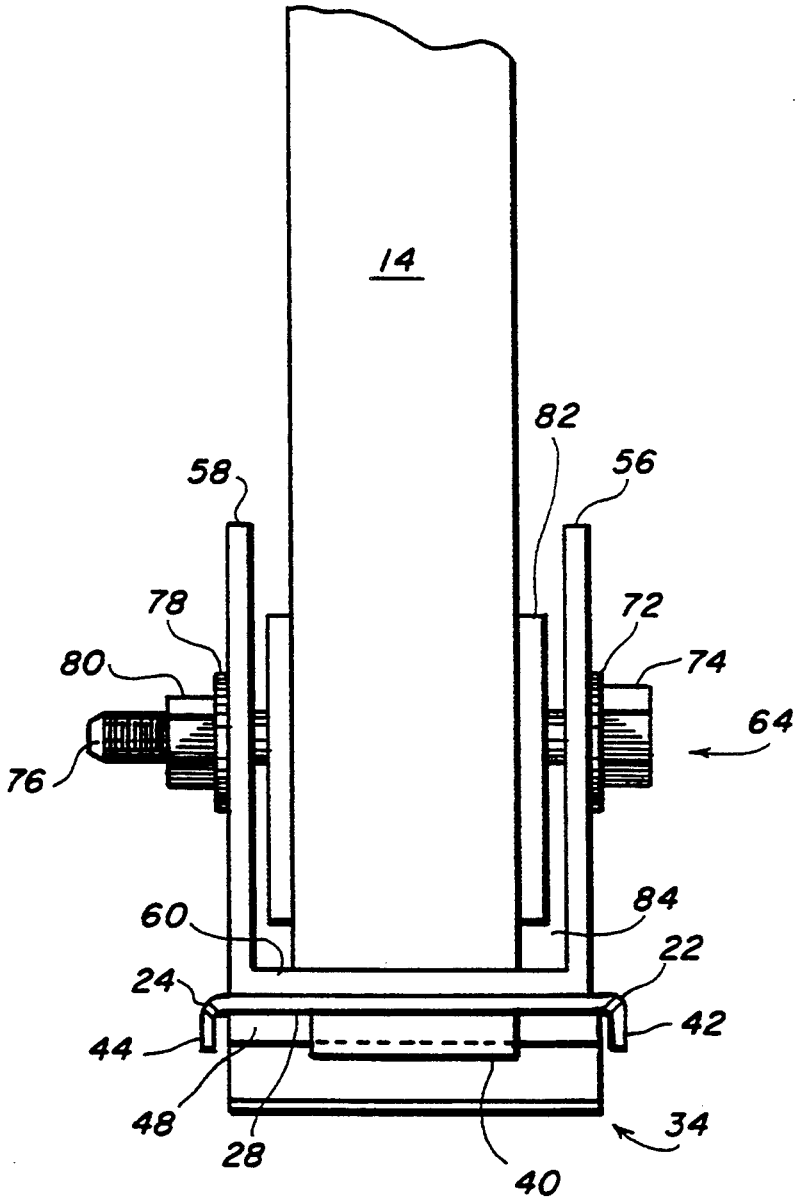
FIG. 2*b* is an end view of the ladder shoe connected to the ladder rail.

As shown in FIG. 2*b*, the fastener 64 is comprised of a washer 72 disposed between the first side plate portion 56 and retaining bolt head 74 of retaining bolt 76. The fastener is also comprised of a second washer 78 disposed between the second side plate portion 58 and locking nut 80. There is a spacer 82 positioned about the ladder rail 14 to limit the gap 84 between the side rail 14, and the first side plate portion 56 and the second side plate portion 58. The bolt 76 fits through the first washer 72, the first side plate portion 56, the spacer 82, the side rail 14, the spacer 82 again, the second side plate portion 58, the second washer 78 and the locking nut 80 in order to maintain the ladder shoe 10 in moveable attachment to the ladder rail 14. The ladder rail attachment portion 12 moves about the bolt 76 relative to the ladder rail 14. As shown in FIG. 2*a*, the ladder rail 14 is moved relative to the ladder shoe 10 so that the ladder shoe 10 can be in the first position when the foot pad 34 rests flat against a support surface 87, as shown in FIG. 3*a*, or in the second position when the teeth 52 of the blade portion 36 extend essentially in parallel with the axis 86 of the ladder rail so that the teeth can penetrate into the ground 88 to hold the ladder 16 in a secure and stable position.

The foot pad 34, as shown in FIGS. 7*a*, 7*b*, 8 and 9, is made of PVC material, having a UV and heat stabilizer of either barium or cadmium of no more than 1%, a filler of calcium carbonate of no more than 7% and a plasticizer of the phthalate type. It should have a brittleness temperature (ASTM DS46) of −30° F. or lower, a hardness value (ASTM D2240) of sphere A 75±5, a tensile strength of at least 1300 psi and elongation of at least 300% of the minimum. The foot pad 34 is comprised of a plurality of tread platforms 90, and preferably six tread platforms 90 which extend from a foot pad platform 92. Each of the tread platforms 90 have individual treads 94 to better grip the support surface 87. The plurality of tread platforms 90 allow for further conformance of the overall gripping surface defined by all the treads 94 of the tread platforms 90 with the support surface 87. Rivets 68 extend through pad holes 89 of foot pad 34 into elongate portion 20, to secure the foot pad 36 to the bottom face 32 of the elongate portion 20.

In the preferred embodiment, and one example of many possible examples which are dictated by the overall size of the ladder and the loads for which the ladder is rated, the first side 22 and second side 24 are 5.625 inches long as measured from the second edge 28 to the tip of a tooth 52. The first edge 26 and second edge 28 are two inches long as measured from the outside of first side 22 to the outside of second side 24. The length of the third flange portion 42 and the fourth flange portion 44 is 0.325 inches as measured from the top face 30 to the end of the third and fourth flange portions. The thickness of the elongate portion 20, first flange portion 38, second flange portion 40, third flange portion 42, and fourth flange portion 44 is 0.075 inches. The length of the second flange portion 40 is 1.250 inches and the length of the first flange portion 38 is 1.0 inches. Each tooth 52 is 0.40 inches long and the distance from a tooth tip to a tooth tip is 0.463 inches. The length of the hook portion 54 on the first flange portion 38 and the second flange portion 40 is 0.20 inches. The distance between holes 66 is 3.0 inches and each hole 66 has a 0.203 diameter.

The thickness of the first side plate portion 56, second side plate portion 58 and bottom plate portion 60 is 0.125 inches. The height of the first side plate portion 56 and second side plate portion 58 is 2.446 inches and the width of the bottom plate portion 60 is 1.70 inches. The distance between the center of the bottom plate portion 60 and the first side plate portion 56 or second side plate portion 58 is 0.725 inches. The length of the bottom plate portion is 4.550 inches.

The foot pad 34 is 4.650 inches long and 1.770 inches wide. The diameter of the pad hole 89 is 0.210 inches and the foot pad platform 92 is 0.188 inches thick. The height of the foot pad 34 is 0.525 inches. The center bore 95 is 0.600 inches in diameter. The head of rivet 68 sits in the center bore 95.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A base for a ladder shoe comprising:

an elongate portion having a first side and a second side, a first edge and a second edge, a top face and a bottom face;

a blade portion extending from said first edge;

a first flange portion extending from said bottom face and integrally connected therewith, said first flange portion having a hook portion;

a second flange portion extending from said bottom face and integrally connected thereto, said second flange portion having a hook portion; and a third flange portion extending from said bottom face and integrally connected thereto; and a fourth flange portion extending from said bottom face and integrally connected thereto, said elongate portion and first and second and third and fourth flange portions being one continuous piece, said first and second and third and fourth flange portions forming a pocket in which the foot pad is held along the bottom face and sides of the foot pad are protected, said hook portion of the first flange portion facing the hook portion of the second flange portion and holding the foot pad, wherein the first flange extends from the bottom face off set and apart from said first edge.

2. A base as described in claim 1 wherein the first flange extends essentially perpendicular from the bottom face.

3. A base as described in claim 2 wherein the first edge is connected to the first side and the second side, and the second edge is connected to the first side and the second side.

4. A base as described in claim 3 wherein the first edge opposes said second edge and said first side opposes said second side; said first edge, second edge, first side and second side forming a rectangular shape.

5. A base as described in claim 4 wherein the first flange opposes the second flange and the third flange opposes the fourth flange.

6. A base as described in claim 5 wherein the second flange extends from the bottom face along the second edge, the third flange extends from the bottom face along the first side, the fourth flange extends from the bottom face along the second side, and the first flange extends from the bottom face adjacent to the first edge.

7. A base as described in claim 6 wherein the elongate portion is flat and defines a plane, and the blade portion extends from the first edge along the plane.

8. A base as described in claim 7 wherein the blade portion includes a plurality of teeth.

9. A base as described in claim 8 wherein the elongate portion, the blade portion and the first, second, third and fourth flanges are made of metal.

10. A ladder shoe comprising:

a ladder rail attachment portion which attaches to a ladder rail of a ladder;

a base comprising:

an elongate portion having a first side and a second side, a first edge and a second edge, a top face and a bottom face, said top face attached to the ladder rail attachment portion;

a foot pad;

a blade portion extending from said first edge;

a first flange portion extending from said bottom face and integrally connected therewith, said first flange portion having a hook portion;

a second flange portion extending from said bottom face and integrally connected thereto, said second flange portion having a hook portion; and a third flange portion extending from said bottom face and integrally connected thereto; and a fourth flange portion extending from said bottom face and integrally connected thereto, said elongate portion and first and second and third and fourth flange portions being one continuous piece, said first and second and third and fourth flange portions forming a pocket in which the foot pad is held along the bottom face and sides of the foot pad are protected, said hook portion of the first flange portion facing the hook portion of the second flange portion and holding the foot pad, said first and second flanges disposed such that they retain the foot pad along the bottom face, wherein the first flange extends from the bottom face off set and apart from said first edge.

11. A base as described in claim 10 wherein the first flange extends essentially perpendicular from the bottom face.

12. A base as described in claim 11 wherein the first edge is connected to the first side and the second side, and the second edge is connected to the first side and the second side.

13. A base as described in claim 12 wherein the first edge opposes said second edge and said first side opposes said second side; said first edge, second edge, first side and second side forming a rectangular shape.

14. A base as described in claim 13 wherein the first flange opposes the second flange and the third flange opposes the fourth flange.

15. A base as described in claim 14 wherein the second flange extends from the bottom face along the second edge, the third flange extends from the bottom face along the first side, the fourth flange extends from the bottom face along the second side, and the first flange extends from the bottom face adjacent to the first edge.

16. A ladder shoe as described in claim 15 wherein the ladder rail attachment portion includes a first side plate portion; a second side plate portion; a bottom plate portion, said first side plate portion and said second side plate portion integrally connected to the bottom plate portion, said bottom portion attached to the top face.

17. A ladder shoe as described in claim 16 wherein said side plates have curved slots through which a fastener is disposed which movably connects the ladder rail attachment portion so the ladder rail attachment portion can move between a first position where the base is at a first angle with respect to the side rail and a second position where the base is at a second angle with respect to the side rail.

18. A ladder shoe as described in claim 17 wherein the first side plate portion, the second side plate portion and the bottom plate portion are being on continuous piece.

19. A ladder shoe as described in claim 18 wherein the first side plate portion is in spaced relationship with said second side plate portion and in parallel with the second side plate portion.

* * * * *